US006540291B2

(12) United States Patent
Hoffman et al.

(10) Patent No.: US 6,540,291 B2
(45) Date of Patent: Apr. 1, 2003

(54) OFF-THE-FLOOR RECLINING CHAIR

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 09/836,489

(22) Filed: Apr. 17, 2001

(65) Prior Publication Data

US 2002/0149238 A1 Oct. 17, 2002

(51) Int. Cl.[7] ..... A47C 1/035
(52) U.S. Cl. ..... 297/85; 297/84; 297/344.4
(58) Field of Search ..... 297/84, 85, 344.21, 297/411.4, DIG. 7

(56) References Cited

U.S. PATENT DOCUMENTS

| | | | | | |
|---|---|---|---|---|---|
| 2,906,318 | A | * | 9/1959 | Schliephacke | 297/85 |
| 3,537,747 | A | * | 11/1970 | Rogers, Jr. | 297/85 |
| 3,603,641 | A | * | 9/1971 | Knabusch | 297/300.5 |
| 3,815,954 | A | * | 6/1974 | Rogers, Jr. et al. | 297/259.2 |
| 4,477,118 | A | * | 10/1984 | Ruble | 297/85 |
| 4,536,029 | A | * | 8/1985 | Rogers, Jr. | 297/281 |
| 4,915,444 | A | | 4/1990 | Rogers, Jr. | |
| 5,087,094 | A | * | 2/1992 | Rogers, Jr. | 297/68 |
| 5,110,179 | A | | 5/1992 | Rogers | |
| 5,120,107 | A | * | 6/1992 | Rogers, Jr. | 297/68 |
| 5,857,739 | A | * | 1/1999 | Smith | 297/88 |

OTHER PUBLICATIONS

Advertisement of push–back chair in golden yellow leather from *Features/Infurniture*.

Picture of reclining chair featuring four features (Advantages).

Back page of Furniture/Today May 13, 2001, vol. 26, No. 35.

Furniture/Today Apr. 15, 2002, vol. 26, No. 32, p. 135 (Hjellegjerde).

Furniture/Today Apr. 15, 2002, vol. 26, No. 32, p. 209 (Motion).

Furniture/Today Apr. 15, 2002, vol. 26, No. 32 p. 237.

* cited by examiner

*Primary Examiner*—Peter M. Cuomo
*Assistant Examiner*—Joe Edell
(74) *Attorney, Agent, or Firm*—Myers Bigel Sibley & Sajovee

(57) ABSTRACT

A reclining chair includes: a base configured to rest on an underlying surface; a swivel unit attached to the base; a chassis assembly mounted to the base; an arm member mounted above the base and to the chassis assembly; a seat having a seat frame, a lowermost portion of the seat frame being located at least 6 inches from the underlying surface; a backrest; an intermediate ottoman; a front ottoman; and a pair of reclining mechanisms mounted to the chassis assembly, the seat and the backrest. The reclining mechanisms are configured to move the seat and backrest relative to the base between an upright position, a "TV" position, and a fully reclined position. The chassis assembly has a first longitudinal dimension. The arm member has a horizontal run and two upright runs. The horizontal run is positioned above and in non-contacting relationship with the underlying surface. Each of the upright runs has a second longitudinal dimension (in this embodiment, preferably between about 3 and 8 inches) that is greater than or substantially equal to the first dimension.

19 Claims, 8 Drawing Sheets

OFF-THE-FLOOR RECLINING CHAIR

FIELD OF THE INVENTION

The present invention relates generally to seating units, and more particularly to recliner chairs.

BACKGROUND OF THE INVENTION

One furniture style that has become popular in recent years is the "off-the-floor" style, which is of European origin. A typical off-the-floor chair has a base with a central pedestal or a pair of arms that extends upwardly therefrom upon which the seat and backrest are supported. The seat, backrest and arms are commonly rather thin and sleek in profile. In typical off-the-floor chairs, the seat is mounted between about 6 and 12 inches above the floor. The sleekness of the seat and backrest profile and the height of the seat above the floor endow the chair with an attractive contemporary appearance.

In many off-the-floor models, the seat is able to swivel (i.e, rotate about a vertical axis) relative to the base and, in some instances, the seat and backrest can tilt as a unit relative to the base. In other units, the backrest and seat are capable of pivoting relative to one another, so that the occupant can more fully recline. The components that control this movement are typically relatively simple, incorporating a single pivot point between the backrest and seat and employing an adjustable pneumatic cylinder to control the resistance to reclining. Often the chair is sold with a separate ottoman that can be positioned forward of the seat to support the occupant's feet when the chair is tilted or reclined. An exemplary chair is available under the trade name STRESS-LESS® by Ekornes, Inc., Somerset, N.J.

The tilting or reclining movement of the type of off-the-floor chair described above does not conform to the movements of traditional recliner chairs, which move between discrete positions and typically include an attached extendable footrest. Conventionally, a recliner chair will move from an upright position, in which the backrest is generally upright, to one or more reclined positions. The movement of the seating unit between the upright and reclined positions is typically controlled by a pair of synchronized reclining mechanisms that are attached to the seat, backrest and base of the chair.

One particularly popular recliner is the "three-way" recliner, which has two reclined positions: a "TV position", in which the footrest or ottoman of the chair is projected forwardly from the chair while the backrest remains substantially upright; and a "fully reclined position", in which the backrest is less upright (i.e., it has been reclined to a shallower angle relative to the floor). In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position.

Many recliner chairs, particularly older models, have been rather bulky. In many instances, the bulk of the chair was necessary or desirable to cover the reclining mechanism when the chair was in the upright position. However, as exemplified above, in some instances it has now become desirable to incorporate a less bulky look into furniture, so designers of recliner chairs have responded with designs intended to present a more contemporary look. For example, U.S. Pat. No. 4,915,444 to Rogers, Jr. illustrates a three-way recliner with a "wrap-around" upholstery layer. The upholstery layer is attached at one end to the rear portion of the seat and at its other end to the front end of the footrest. In the upright position, the footrest folds under the front portion of the seat in a generally horizontal disposition, such that the upholstery layer covers the upper surface of the seat, the lower surface of the footrest, and the front surface of the chair between the seat and the footrest.

One difficulty presented with chairs of the "wrap-around" style is the tendency of the upholstery layer to bunch or stretch when the footrest is moved to an extended position. This can occur when the "wrap-around" distance between the footrest and the seat changes depending on whether the footrest is in the extended or retracted position. One approach to solving this problem involves the use of elastic material sewn into the upholstery pad, which enables the upholstery to stretch or contract as necessary. Of course, this approach can increase the cost of manufacturing the chair. Another approach is to include more than one footrest board, such that the upholstery layer is attached to one or the other of the footrest boards, but not both. This approach is illustrated in U.S. Pat. No. 5,087,094 to Rogers, Jr., which illustrates three different recliner "wrap-around" chairs. None of the chairs illustrated therein are off-the-floor chairs of the style described above.

It would be desirable to provide an off-the-floor chair with reclining capability, and in particular to provide a chair that can move to discrete reclined positions, while retaining the attributes of the desirable off-the-floor appearance.

SUMMARY OF THE INVENTION

The present invention can address some of the shortcomings of the prior art by providing a wrap-around recliner chair with an off-the-floor style. A chair of the present invention comprises: a base configured to rest on an underlying surface; a swivel unit attached to the base; a chassis assembly mounted to the base; an arm member mounted above the base and to the chassis assembly; a seat having a seat frame, a lowermost portion of the seat frame being located at least 6 inches from the underlying surface; a backrest; an intermediate ottoman; a front ottoman; and a pair of reclining mechanisms mounted to the chassis assembly, the seat and the backrest. The reclining mechanisms are configured to move the seat and backrest relative to the base between:

(a) an upright position, in which the backrest is generally upright, the seat is positioned above the base in a first position and forms a first angle with the backrest, the intermediate ottoman is disposed generally vertically and serves as a front portion of the chair, and the front ottoman is disposed generally horizontally below the seat and rearward of the intermediate ottoman;

(b) a TV position, in which the front ottoman is generally horizontally disposed and inverted from its disposition in the upright position forward of the seat, the intermediate ottoman is generally horizontally disposed between the front ottoman and the seat, and the seat has moved to second position rearwardly from the first position, and the backrest and seat form a second angle that is substantially equal to the first angle; and (c) a fully reclined position, in which the front and intermediate ottomans remain generally horizontally disposed forward of the seat, the seat moves to a third position that is upward from the second position, and the backrest has pivoted relative to the seat such that a third angle formed by the backrest and the seat is greater than the second angle.

The chassis assembly has a first longitudinal dimension. The arm member has a horizontal run and two upright runs. The horizontal run is positioned above and in non-contacting relationship with the underlying surface. Each of the upright runs has a second longitudinal dimension (in this embodiment, preferably between about 3 and 8 inches) that is greater than or substantially equal to the first dimension. The upright runs are positioned relative to the chassis assembly such that the chassis assembly is substantially hidden thereby in side view.

In one embodiment, the chassis assembly has a longitudinal dimension of between about 3 and 8 inches, and the upright runs have a longitudinal dimension of between about 3 and 8 inches. In this embodiment, it is preferred that the seat frame have a lowermost portion that is located between about 6 and 10 inches above the underlying surface.

In another embodiment, the reclining mechanisms include: a seat mounting bracket attached to the seat frame; front and rear ottoman extension links pivotally attached to the seat mounting bracket; upper and lower ottoman extension links pivotally attached to, respectively, the rear and front ottoman swing links; an intermediate ottoman drive link pivotally attached to the upper ottoman extension link; and an intermediate ottoman bracket pivotally attached to the lower ottoman extension link and to the intermediate ottoman drive link and mounted to the intermediate ottoman, wherein the upper and lower ottoman extension links are pivotally attached to each other. The reclining mechanisms also include a front ottoman carrier link pivotally attached with the upper and lower ottoman extension links, a front ottoman bracket pivotally attached to the front ottoman carrier link and fixed to the front ottoman, and a front ottoman drive link pivotally attached to the lower ottoman extension link and to the front ottoman bracket. In this embodiment, it is preferred that the intermediate ottoman has a first length, the front ottoman has a second length, and the second length is greater than the first length.

As another aspect of the present invention, the aforementioned chassis assembly is adapted to interconnect a chair base with a pair of reclining mechanisms and includes: a pair of longitudinally-extending lower tube segments; a pair of transversely-extending upper tube segments fixedly mounted upon the lower tube segments; a lower plate fixedly mounted to and below the upper tube segments; and an upper plate fixedly mounted to and above said upper tube segments. The upper and lower plates are adapted to be fixedly mounted to the chair base, and the upper tube segments are adapted to be mounted beneath the pair of reclining mechanisms. In this configuration, the chassis assembly can provide a strong and stable interconnection between the base and the reclining mechanisms and remain substantially obscured from view by an arm member of the chair.

With one or more of the aforementioned aspects, the present invention can provide a chair that has aesthetic appeal and contemporary style, yet also has the function of a three-way recliner chair. Wrap-around upholstery can be attached without the need for components that compensate for stretching or bunching of the upholstery. The reclining mechanisms can be substantially obscured by the side rails of the seat frame, thereby preserving the attractive appearance of the chair. The front and intermediate ottomans can provide comfortable support for the occupant's legs and feet without the need for a separate footstool-type ottoman. Finally, the chassis assembly can by configured to provide attachment points for the reclining mechanisms without sacrificing chair style.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention is directed to a reclining chair having a stationary base, a seat, and a backrest. As used herein, the terms "forward", "front" and derivatives thereof refer to the direction defined by a vector extending from the backrest toward the seat parallel to the underlying surface. Conversely, the terms "rearward" and derivatives thereof refer to the direction directly opposite the forward direction; i.e., the rearward direction is defined by a vector that extends from the seat toward the backrest parallel to the underlying surface. The forward and rearward directions together comprise the "longitudinal" directions relative to the chair. The term "outward" and derivatives thereof refer to the direction defined by a vector originating in the center of the seat and extending in the plane of the underlying surface and perpendicular to the forward and rearward directions. The terms "inboard", "inward" and derivatives thereof refer to the direction directly opposite to the lateral direction as defined hereinabove. The outward and inward directions together comprise the "lateral" or "transverse" directions relative to the chair.

Figure 1:
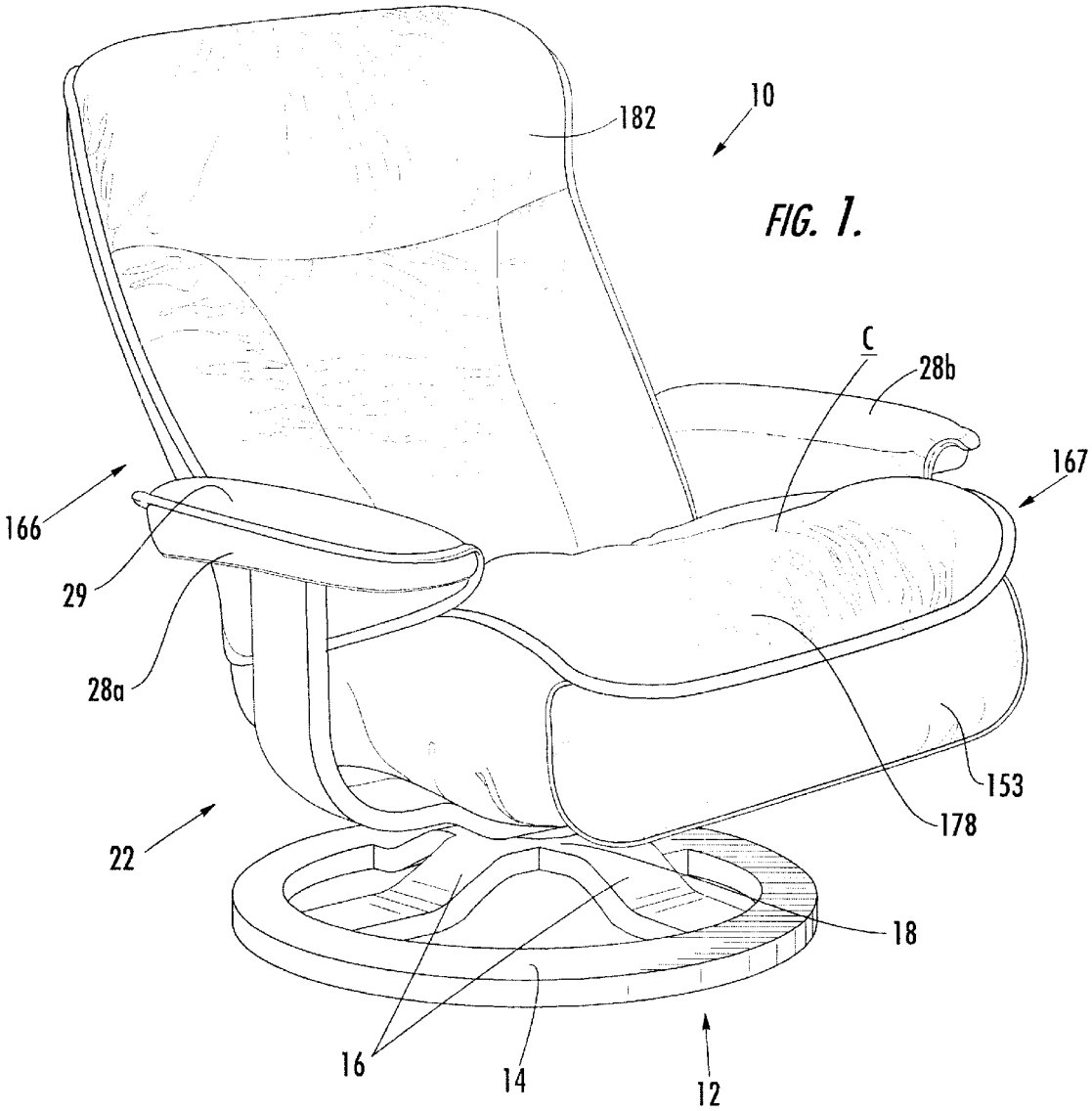
FIG. 1 is a perspective view of a recliner chair of the present invention.

Referring now to the drawings, a chair, designated broadly at 10, is illustrated in FIGS. 1–6. Referring first to FIG. 1, the chair 10 includes a base 12, a chassis assembly 30 (seen best in FIGS. 2–6), an arm member 22, a seat 167, a backrest 166, a pair of ottomans 153, 163, and a pair of reclining mechanisms 50*a*, 50*b* that control the movement of these components relative to one another. Each of these structures is described in detail hereinbelow.

The base 12 comprises spokes 16 which extend radially outwardly from a central hub portion 18 to a circular ring 14. The ring 14 is generally planar and is configured to contact the surface underlying the chair 10. The spokes 16 are slightly arcuate and form the skeleton of a shallow dome. A central pedestal 20 extends upwardly from the hub 18. These components of the base 12, which are the components that largely define the appearance of the base 12, are typically formed of wood, and are generally formed separately and interconnected via adhesives, dowels, and the like.

The appearance of the base 12 is one that is considered desirable for off-the-floor chairs, but is not essential to the practice of the present invention. Those skilled in this art will recognize that other base configurations and styles (e.g., those with a differently shaped ring or a different number of spokes) may also be employed with the present invention.

Figure 2:
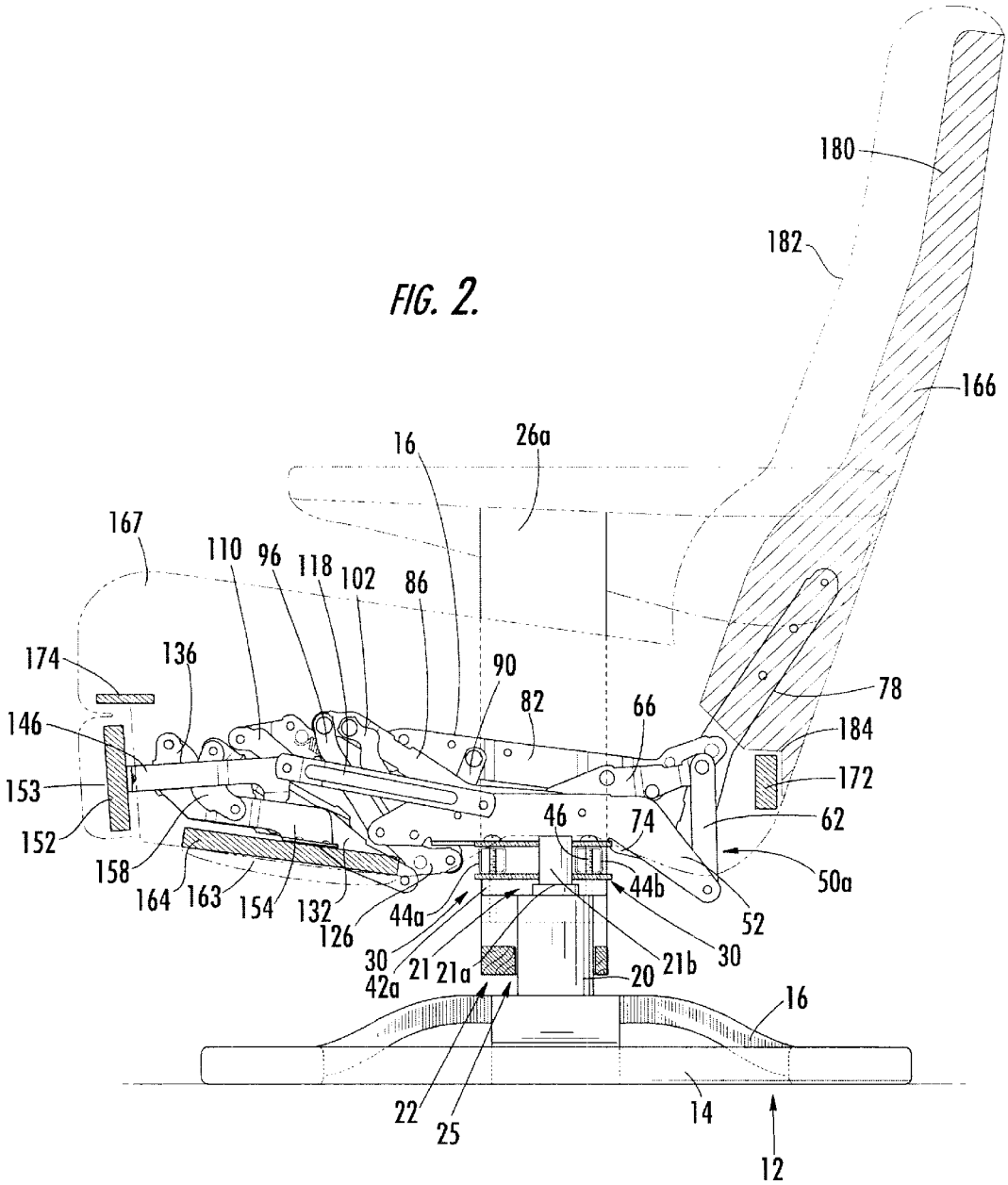
FIG. 2 is a cutaway side view of the chair of FIG. 1 with the chair in the upright position.
Figure 5:
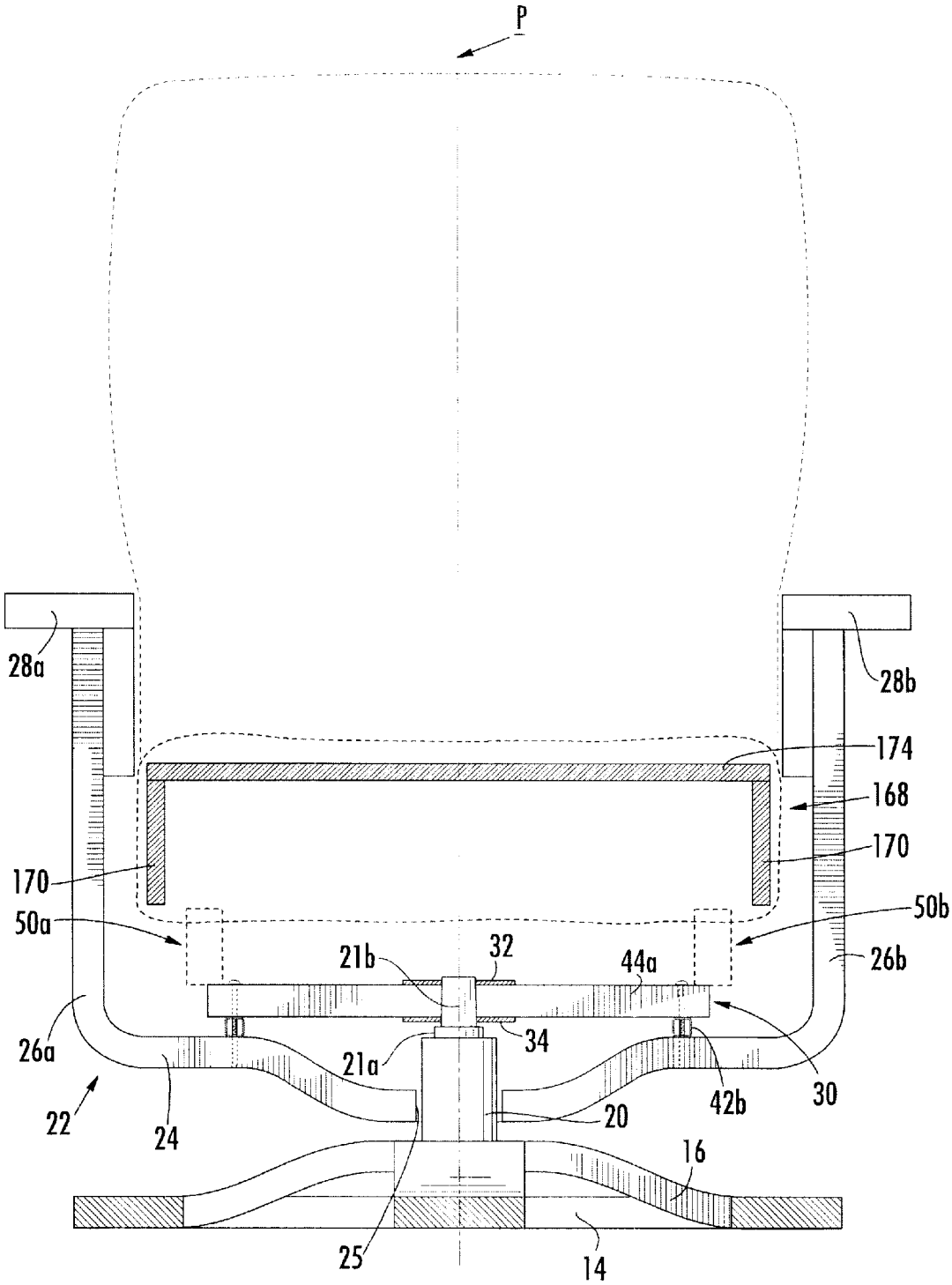
FIG. 5 is a front view of the base and the arm member chair of FIG. 1 with the seat and backrest in dotted line.
Figure 6:
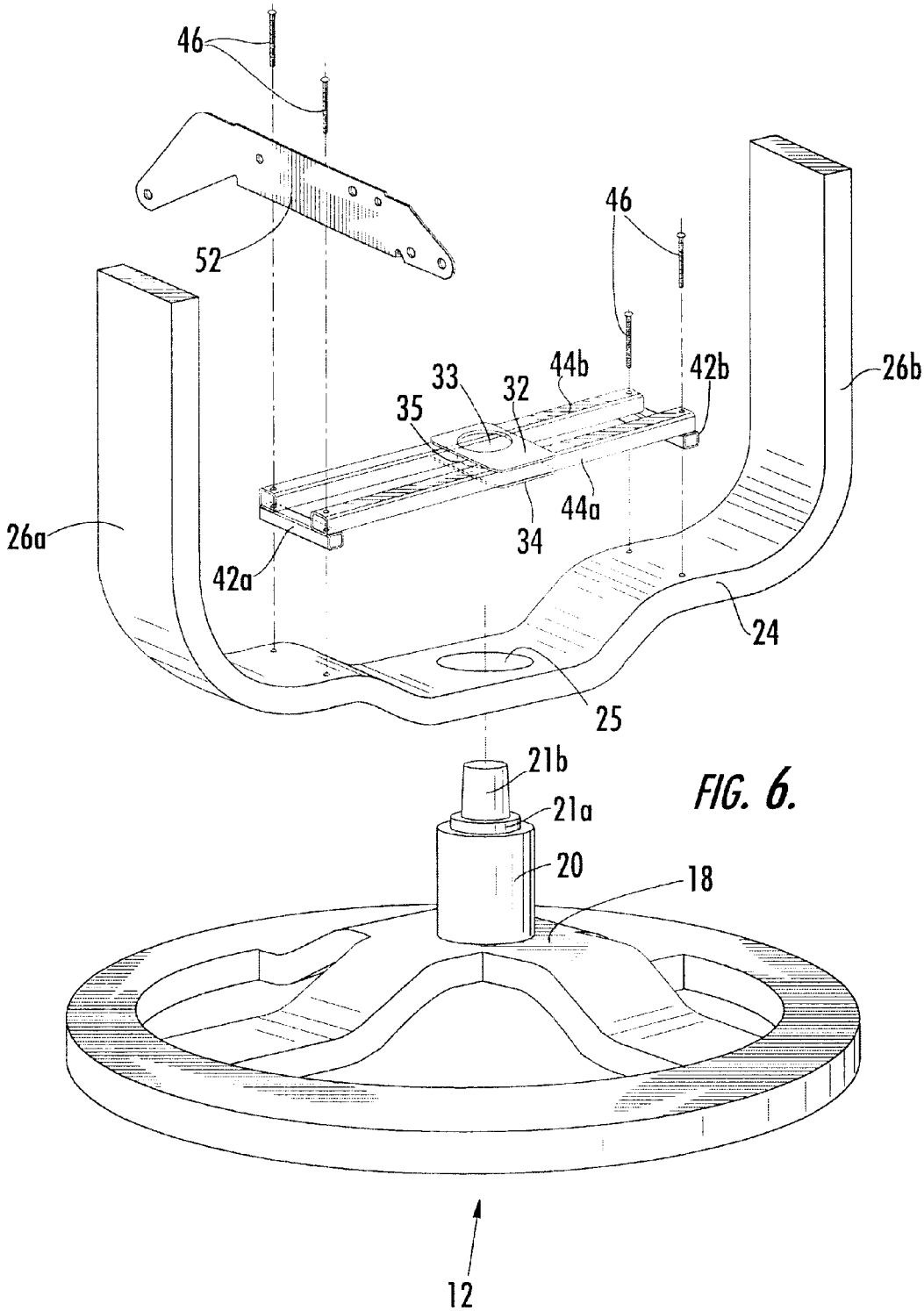
FIG. 6 is an exemplary perspective view of the base, arm member and chassis assembly of FIG. 1.

Referring now to FIGS. 2 and 5, the base 12 also includes a swivel unit 21 that is mounted atop the pedestal 20. The swivel unit 21 includes a mounting cup 21*a* that is fixed to the pedestal 20 and a spindle 21*b* that is rotatably mounted within the mounting cup 21*a*. The spindle 21*b* is generally cylindrical and tapers as it rises upwardly from the mounting cup 21*b*.

Referring still to FIGS. 2 and 5, the arm member 22, preferably formed of a single member of wood, includes a generally transversely-oriented horizontal run 24 merging smoothly at its lateral ends with two generally upright runs 26*a*, 26*b*. The horizontal run 24 dips arcuately in its central portion, where an aperture 25 located therein encircles the pedestal 20 of the base 12. At the top of each upright run 26*a*, 26*b* is a respective generally horizontal armrest 28*a*, 28*b* that extends longitudinally. Notably, for aesthetic appeal the horizontal run 24 and upright runs 26*a*, 26*b* are relatively narrow in the longitudinal direction (a longitudinal dimension of between about 3 and 7 inches is preferred), with the armrests 28*a*, 28*b* extending in a cantilevered fashion both forwardly and rearwardly of the upright runs 26*a*, 26*b*. An upholstery pad 29 covers each armrest 28*a*, 28*b*.

Those skilled in this art will appreciate that arm members of other configurations may be used with the present invention. For example, the horizontal run may not descend in its central portion, or it may comprise two separate members, or may descend in its central portion on a different manner. It is preferred that the central portion of the horizontal run 24 be between about 1 and 5 inches lower than the remainder of the horizontal run 24.

Referring again to FIGS. 2 and 5, the chassis assembly 30 includes an upper plate 32 and a lower plate 34. The upper and lower plates 32, 34 each include a respective aperture 33, 35 that fits snugly on the tapered spindle 21*b*, such that the upper and lower plates 32, 34 rotate with the spindle 21*b*.

The chassis assembly 30 also includes two lower segments of tubing 42*a*, 42*b* (preferably formed of steel) that rest upon the upper surface of the horizontal run 24 of the arm member 22 inboard of the upright runs 26*a*, 26*b*. The lower tubing segments 42*a*, 42*b* extend longitudinally for a distance (typically between about 3 and 7 inches) that permits them to be hidden by the armrest 28*a*, 28*b* when viewed from the side. The lower tubing segments 42*a*, 42*b* are preferably formed of steel, square in cross-section and about ¾ inch in height and width. A segment of upper tubing 44*a* extends between the forward ends of the lower tubing segments 42*a*, 42*b*; similarly, a segment of upper tubing 44*b* extends between the rear ends of the lower tubing segment 44*a*, 44*b*. The upper tubing segments 44*a*, 44*b* are preferably formed of steel, square in cross-section, and about 1 inch in height and width. The upper tubing segments 44*a*, 44*b* are positioned atop the lower tubing segments 42*a*, 42*b*, and are welded or otherwise fixed thereto. Although steel is the preferred material for the upper and lower tubing segments 44*a*, 44*b*, 42*a*, 42*b*, other materials, such as plastic or wood, may also be employed.

The lower plate 34 of the chassis assembly 30 is attached (preferably via welding) to the lower surfaces of the upper tubing 44*a*, 44*b*, and the upper plate 32 is attached (also preferably via welding) to the upper surfaces of the upper tubing 44*a*, 44*b*. The chassis assembly 30 is then attached as a unit to the base 12 via fitting of the apertures 33, 35 of the upper and lower plates 32, 34 to the spindle 21*b*. Also, the chassis assembly 30 provides a mounting location for the arm member 22 via fasteners 46 inserted through the upper tubing segments 44*a*, 44*b* and the lower tubing segments 42*a*, 42*b* and into the horizontal run 24 of the arm member 22.

Those skilled in this art will recognize that other chassis assembly configurations may also be employed with the present invention. For example, the arm member 22 may be mounted elsewhere (such as to the base), or the longitudinally-extending tubing may be mounted above the transversely-extending tubing.

Figure 3:
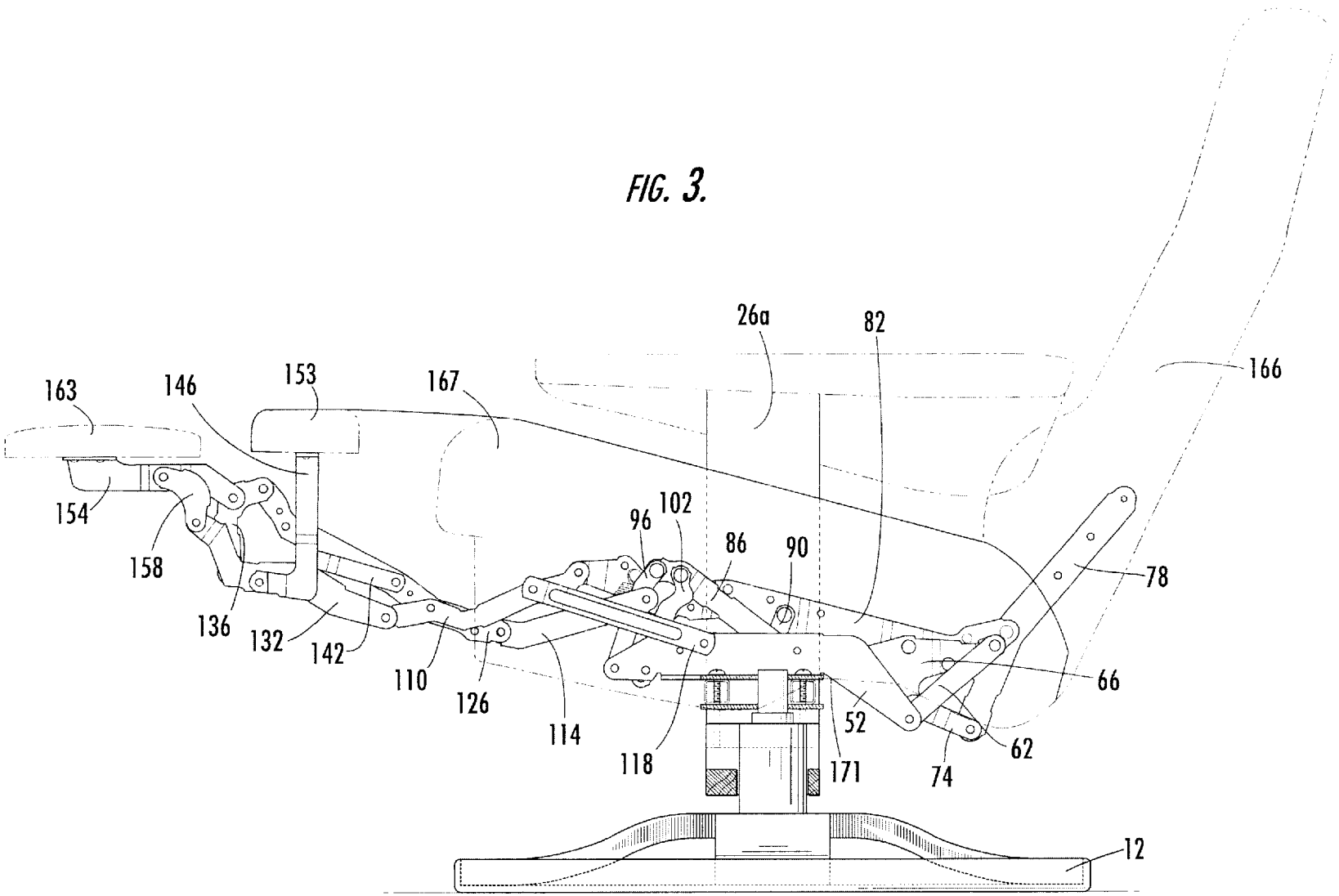
FIG. 3 is a cutaway side view of the chair of FIG. 1 with the chair in the TV position.
Figure 4:
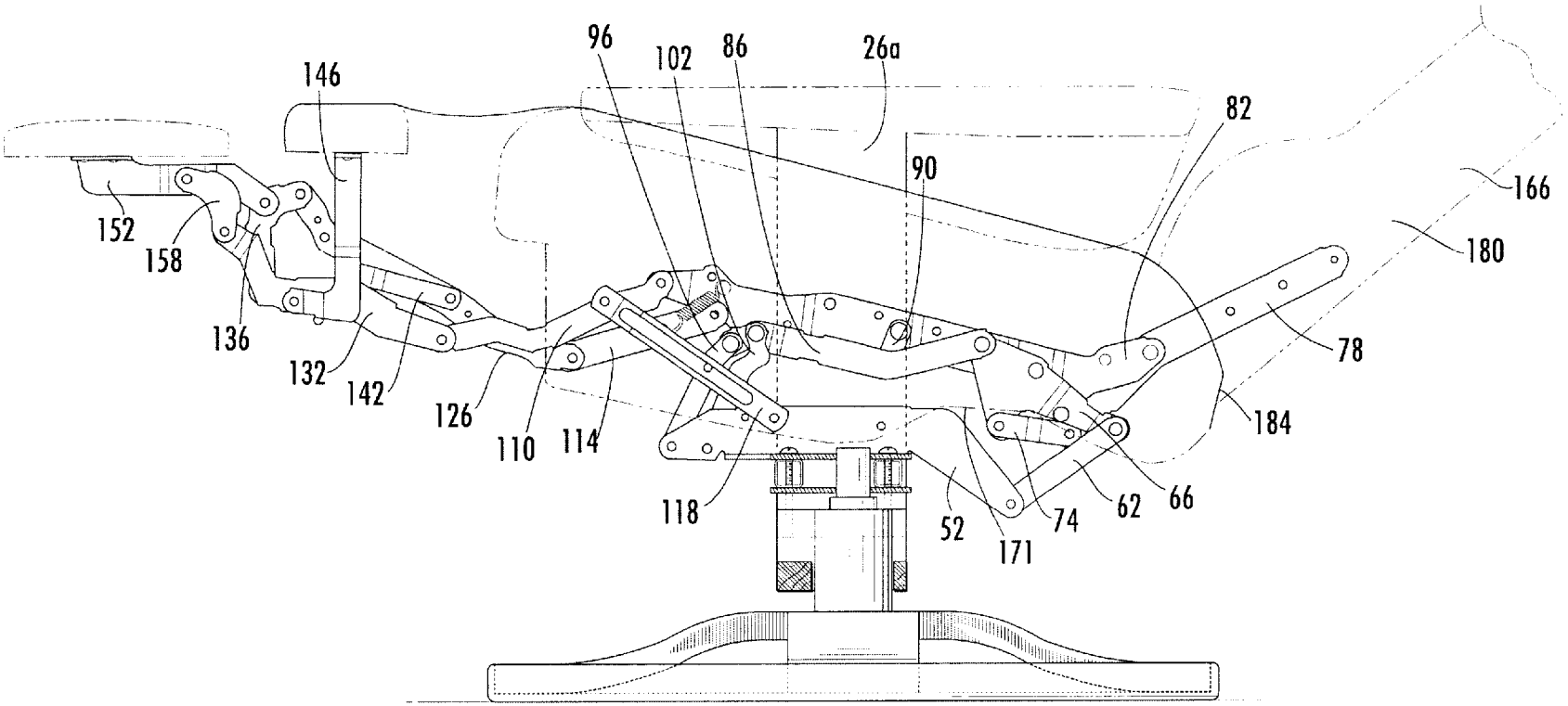
FIG. 4 is a cutaway side view of the chair of FIG. 1 with the chair in the fully reclined position.

Referring now to FIGS. 2–4, the chair 10 includes the reclining mechanisms 50*a*, 50*b* discussed above that enable the chair 10 to move between upright, TV and fully reclined positions (i.e., the reclining mechanisms 50*a*, 50*b* are three-way reclining mechanisms). The reclining mechanisms 50*a*, 50*b* are mirror images of one another about a vertical plane P (shown in FIG. 5) that extends longitudinally through the center of the chair 10. As such, only one reclining mechanism 50*a* is illustrated and will be described herein, with the understanding that those skilled in the art will recognize that this discussion is equally applicable to the reclining mechanism 50*b* also.

In addition, the mechanisms 50*a*, 50*b* are illustrated herein as a series of pivotally interconnected links. Those skilled in this art will appreciate that the pivots between links can take a variety of configurations, such as pivot pins, rivets, bolt and nut combinations, and the like, any of which would be suitable for use with the present invention.

Figure 2A:
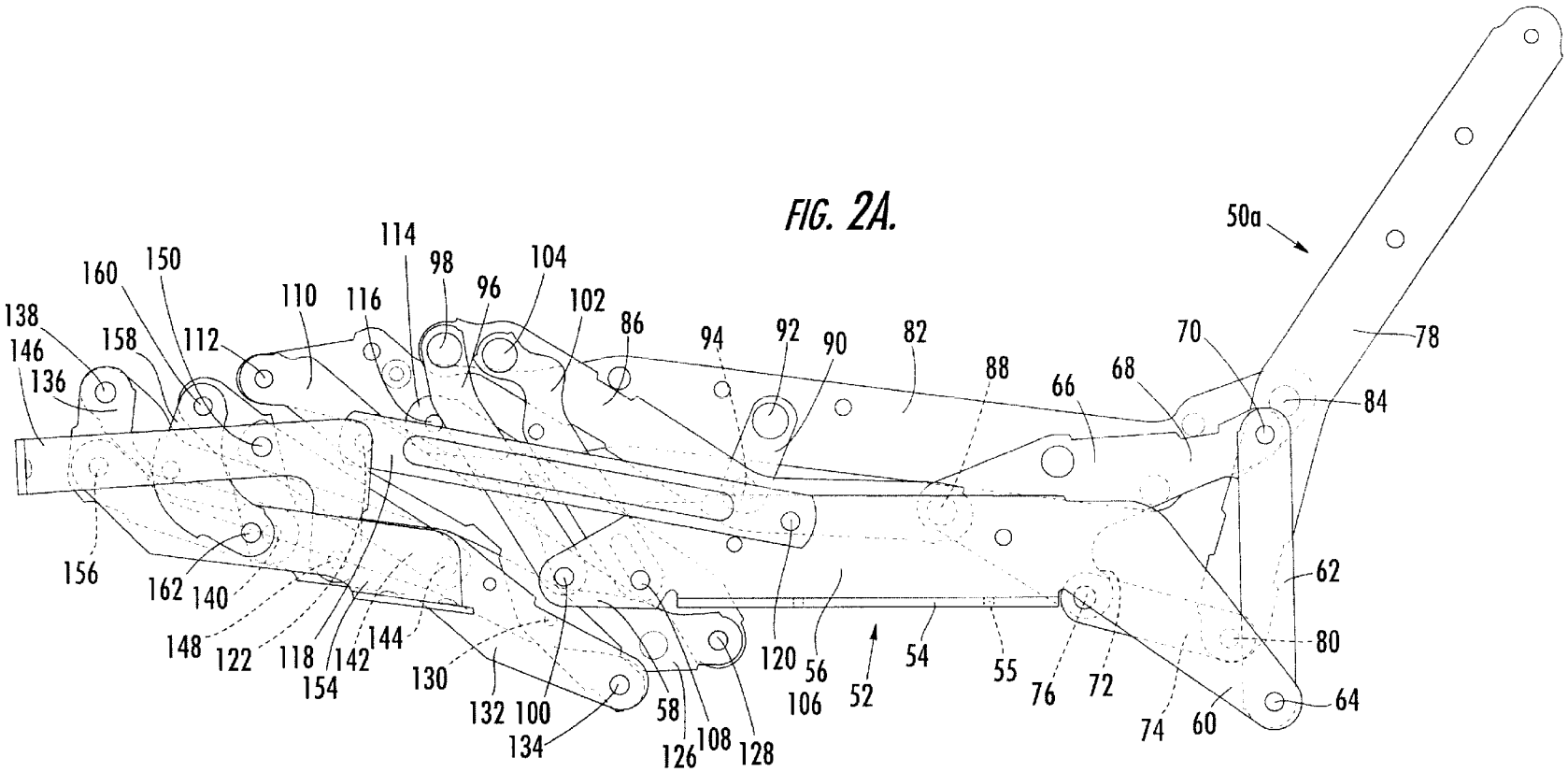
FIG. 2A is an enlarged view of the reclining mechanism illustrated in FIG. 2 that shows all links of the mechanism in solid and broken line.
Figure 2B:
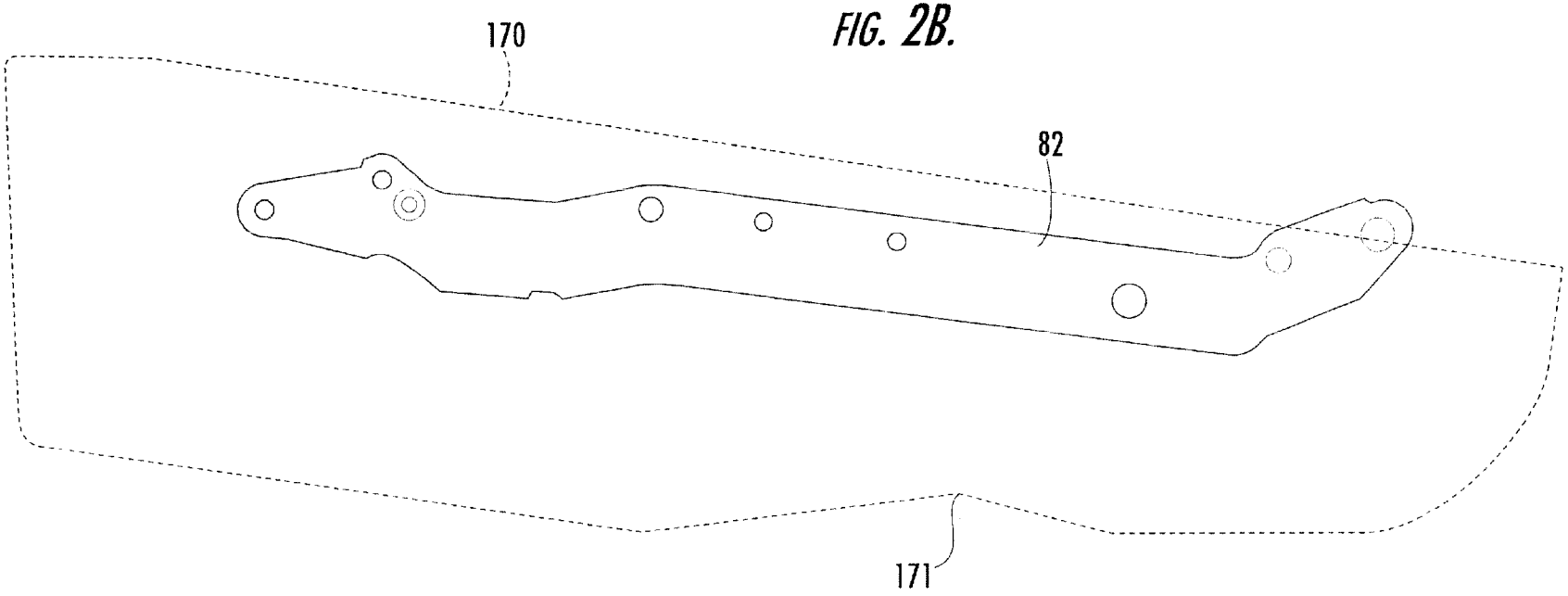
FIG. 2B is a side view of the seat mounting bracket and the seat frame side rail of the chair of FIG. 1.

The reclining mechanism 50*a* includes linkages that control the movement of the seat frame 167 relative to the base 12, the movement of the front and intermediate ottomans 153, 163 relative to the seat 167, and the backrest 166 relative to the seat 167. The functions of each of the links comprising these linkages will be explained below. Further, in the interest of clarity, initially the mechanism 50*a* will be described with respect to FIGS. 2 and 2A, in which the chair 10 is in its upright position; thus, the individual links comprising the mechanism 50*a* will be described with their orientations as shown in FIGS. 2 and 2A. Subsequently, the positions and orientations of the individual links will be described with respect to FIGS. 3 and 4, in which the chair 10 is illustrated in its TV and fully reclined positions, respectively.

Referring now to FIGS. 2 and 2A, the reclining mechanism 50*a* includes a mounting bracket 52 having a horizontal panel 54 and a vertical panel 56. The horizontal panel 54 includes mounting apertures 55 that are aligned above the joint between the upper tubing segments 44*a*, 44*b* and 9the lower tubing segments 42*a* and receive fasteners 46. Thus, the mounting bracket 52 and chassis assembly 30 are attached to the arm member 22 via fasteners 46. The vertical panel 56 of the mounting bracket 52 is positioned laterally of the horizontal panel 54 and includes a forward portion 58 that extends forwardly of the upper plate 32 and a rear finger 60 that extends rearwardly and downwardly of the upper plate 32. Thus, the mounting bracket 52 provides a mounting location for the remainder of the reclining mechanism 50*a*.

Still referring to FIGS. 2 and 2A, a substantially straight rear swing link 62 is attached at one end to the rear finger 60 of the mounting bracket 52 at a pivot 64 and extends upwardly and slightly forwardly therefrom. A front swing link 96 is attached at one end to the forward portion 58 of the mounting bracket 52 at a pivot 100 and extends upwardly and forwardly therefrom. The upper ends of the rear swing link 62 and the front swing link 96 are interconnected via a slightly bent transition link 86, which is attached at its forward end to the upper end of the front swing link 96 at a pivot 98, and a full recline swing link 66, which includes a rear projection 68 and a tab 72. The rear projection 68 is attached to the end of the rear swing link 62 opposite the pivot 64 at a pivot 70. The front end of the full recline swing link 66 is attached to the rear end of the transition link 86 at a pivot 88. A short carrier link 90 extends downwardly and slightly forwardly from a pivot 92 with a seat mounting bracket 82 to a pivot 94 with the intermediate portion of the transition link 86. The seat mounting bracket 82 is then mounted to the seat frame 168 of the seat 167. These links largely control the movement of the seat frame 168 relative to the base 12.

Referring again to FIGS. 2 and 2A, a straight recline actuating link 74 is attached to the tab 72 of the full recline swing link 66 at a pivot 76 and extends rearwardly therefrom. A generally upright backpost 78 is attached at its upper end to the backrest 166 of the chair 10 and at its lower end to the rearward end of the recline actuating link 74 at a pivot 80. The seat mounting bracket 82, which extends longitudinally much of the length of the seat 167, is attached at its rear portion to a central portion of the backpost 78 via a pivot 84. These links are largely responsible for controlling the pivoting of the backrest 166 relative to the seat 167.

Referring yet again to FIGS. 2 and 2A, the remaining links are largely responsible for the extension of the front and intermediate ottomans 163, 153. A sequencer link 102 extends generally parallel with the front swing link 96 and is connected with the transition link 86 at a pivot 104 located just rearwardly from the pivot 98. At its opposite end, the sequencer link 102 has a slot 106 that slidably and pivotally interacts with a pin 108 located at the forward end of the mounting bracket 52; in the upright position, the pin 108 is seated in the lower end of the slot 106. A front ottoman swing link 110 is attached to the forwardmost end of the seat mounting bracket 82 at a pivot 112 and extends rearwardly and downwardly therefrom. A substantially parallel rear ottoman swing link 114 is attached to the seat mounting bracket 82 at a pivot 116 positioned rearward and downward of the pivot 112. An ottoman actuator link 118 is attached to the front ottoman swing link 110 at a pivot 122 and extends rearwardly and slightly downwardly to a pivot 120 on the mounting bracket 52. A long upper ottoman extension link 126 is attached to the rear end of the rear ottoman swing link 114 at a pivot 128 and to an intermediate portion of the front ottoman swing link 110 at a pivot 130. The upper ottoman extension link 126 extends forwardly and slightly upwardly from the pivot 130 to terminate near the front end of the seat 167. A tripartite lower ottoman extension link 132 is disposed generally parallel to the upper ottoman extension link 126 and is attached at one end to the end of the front ottoman swing link 110 at a pivot 134. An L-shaped front ottoman carrier link 136 is attached at one end to the end of the upper ottoman extension link 126 at a pivot 138, and at its other end to an intermediate portion of the lower ottoman extension link 132 at a pivot 140. The front ottoman swing link 110, rear ottoman swing link 114, upper ottoman extension link 126, lower ottoman extension link 132 and front ottoman carrier link 136 form a pantographic linkage that extends the ottomans 153, 163 in a "scissors" fashion to a position forward of the seat frame 168. This movement is driven by the ottoman actuator link 118.

A straight intermediate ottoman drive link 142 is attached at one end to an intermediate portion of the upper ottoman extension link 126 at a pivot 144 and extends upwardly and forwardly therefrom. An L-shaped intermediate ottoman bracket 146 is attached at one end at a pivot 148 to an intermediate portion of the lower ottoman extension link 132 and extends upwardly, then forwardly to terminate at an intermediate ottoman block 152 located just forwardly of the seat frame 168. The intermediate ottoman drive link 142 is attached at its forward end to an intermediate portion of the intermediate ottoman bracket 146 at a pivot 150. The intermediate ottoman drive link 142 and intermediate ottoman bracket 146 are driven by the upper ottoman extension link 126 and lower ottoman extension link 132 to control the movement of the intermediate ottoman 153.

A front ottoman bracket 154 is attached at a pivot 156 to the front ottoman carrier link 136. At its opposite end, the front ottoman bracket 154 is attached to a front ottoman block 164. An L-shaped front ottoman drive link 158 is attached at one end to the end of the lower ottoman extension link 132 at a pivot 160 and at its opposite end to an intermediate portion of the front ottoman bracket 154 at a pivot 162. The front ottoman carrier link 136, front ottoman drive link 158, and front ottoman bracket 154 control the movement of the front ottoman 163.

Referring now to FIGS. 2, 2B and 4–6, the seat 167 includes a seat frame 168 which includes a pair of side rails 170, a rear rail 172 and a front rail 174. The side rails 170 extend longitudinally and are positioned laterally of the seat mounting brackets 82. Also, the side rails 170 are between about 4 and 8 inches in height, which enables the chair 10 to maintain a sleek profile while still hiding the reclining mechanisms 50*a*, 50*b* from view when the chair 10 is in the upright position. The lowermost portions of the side rails 170 are preferably between about 6 and 10 inches above the underlying surface to enhance the appearance of the chair 10. Each of the side rails 170 includes a cutaway portion 171 that is shaped to prevent the side rail 170 from striking the horizontal run 24 of the arm member 22 as the chair 10 moves to its TV and fully reclined positions.

Still referring to FIGS. 2, 2B and 4–6, the front rail 174 extends transversely between the front ends of the side rails 170. The front rail is 174 mounted such that, in cross-section, its longer side is horizontally disposed, with the result that there is open space at the front of the seat frame 168 below the front rail 174 in which the reclining mechanisms 50*a*, 50*b* can extend. The rear rail 172 extends between the rear ends of the side rails 170. A deck (not shown, and which can be formed of springs, decking straps, or the like) extends between the rails 170, 172, 174 to provide a support surface within the seat frame 168.

Referring again to FIGS. 4–6, the backrest 166, which comprises a frame 180 and upholstery 182, is attached to the upper portion of the backposts 78. The frame 180 includes a notch 184 at its lower edge that meets the rear upper edge of the rear rail 172 of the seat frame 168 when the chair 10 is in the fully reclined position.

Referring now to FIGS. 1 and 2, an upholstery layer 178 is attached to the rear portion of the seat frame 168. The upholstery layer 178 preferably comprises a single piece of fabric that extends the entire "wrap-around" distance from the rear portion of the seat 167 to the lower edge of the intermediate ottoman block 152. As used herein, the "wrap-around" distance is defined as the distance that a flexible measuring device, such as a string or flexible tape, would extend if placed in contact with the upholstery layer. Thus, when the chair 10 is in the upright position, the wrap-around distance between the rear of the seat 167 and the lower edge of the intermediate ottoman 153 is the distance that a flexible measuring device would extend forwardly from the rear of the seat 167 and downwardly from the front end of the seat 167 to the lower edge of the intermediate ottoman 152 following the contour of the upholstery layer 178. Because the movement of the intermediate ottoman 153 and the seat 167 is such that the wrap-around distance between the seat 167 and the intermediate ottoman 154 remains substantially constant, it is preferred that the upholstery layer 178 be fixed to the seat 167 and the intermediate ottoman 153 without elastic or other components that would compensate for the stretching or bunching of the upholstery layer 178. It is also preferred that the "crown" portion C of the seat 167 (the lowest portion of the front edge of the seat 167) be between about 15 and 22 inches from the underlying surface.

To move the chair 10 from the upright position of FIG. 2 to the TV position of FIG. 3, the occupant of the chair 10 pushes on the armrests 28*a*, 28*b* while pressing back with his back on the backrest 166. This rearwardly-directed force causes the backpost 78 to draw the top end of the rear swing link 62 and the seat mounting bracket 82 rearwardly. After the top end of the rear swing link 62 travels rearwardly of the pivot 64, the mechanisms 50*a*, 50*b* release to the TV position, in which the seat 167 moves rearwardly relative to the base 12. The rearward movement of the rear swing link 64 draws the full recline swing link 66 and, in turn, the transition link 86 rearwardly with little to no rotation; similarly, the carrier link 90 and the recline actuating link 74 are drawn rearwardly, but do not rotate substantially relative to the backpost 78 and base 12.

Referring again to FIG. 3, the rearward movement of the transition link 86 draws the top ends of the front swing link 96 and the sequencer link 102 rearwardly. Also, the rearward movement of the seat mounting bracket 82 causes the footrest actuator link 118 to drive the lower end of front ottoman swing link 110 forward. This action causes the lower end of the upper ottoman extension link 126 to extend, thereby drawing the lower end of the rear ottoman swing link 114 forward. Extension of the upper ottoman extension link 126 also causes the front ottoman carrier link 136 to rotate (clockwise as shown in FIGS. 2 and 3), which in turn draws the lower end of the lower ottoman extension link 132 forward. The movement of the upper and lower ottoman extension links 126, 132 ceases when the front ottoman swing link 110 contacts a pin 127 located on the upper ottoman extension link 126.

Still referring to FIG. 3, as the upper and lower ottoman extension links 126, 132 extend forwardly, the intermediate ottoman drive link 142 and the intermediate ottoman bracket 146 are carried forward also. The intermediate drive link 142 substantially maintains its orientation, but the movement of the lower ottoman extension link 132 causes the intermediate ottoman bracket 146 to rotate about the pivot 148 such that the intermediate ottoman block 152 rises and rotates to a generally horizontal disposition (the rotation is clockwise from the vantage point of FIG. 3).

Also, the extension of the upper and lower ottoman extension links 126, 132 carries the front ottoman drive link 158 and the front ottoman bracket 154 forward. As the front ottoman carrier link 136 rotates, it causes the front ottoman bracket 154 to rotate around the pivot 156 (the rotation is clockwise from the vantage point of FIG. 3). This rotation is controlled by the front ottoman drive link 158, which also rotates clockwise. The rotation of the front ottoman bracket 154 is sufficient to invert the front ottoman block 164 from a horizontal disposition in which the front ottoman 163 faces downwardly to a horizontal disposition in which the front ottoman 163 faces upwardly.

Notably, in moving to the TV position, the intermediate ottoman 163 has not increased the wrap-around distance between itself and the rear portion of the seat 167. This is accomplished by the interaction of the intermediate ottoman bracket 146 and the intermediate ottoman drive link 142 with the upper and lower ottoman extension links 126, 132. The maintenance of the wrap-around distance enables the upholstery layer 178 to be fixed in place on both the seat 167 and the intermediate ottoman 153 without elastic or other components to take up slack in or prevent stretching of the upholstery layer 178. Thus, the intermediate ottoman 153 is able to serve as the front surface of the chair 10 when it is in the upright position and as a footrest when the chair 10 is in the TV position.

It is also notable that the front ottoman 163 is considerably larger than the intermediate ottoman 153. In some furniture styles, and particularly in off-the-floor styles, the profile of the seat 167 is such that a lengthy intermediate ottoman (i.e., one that would be rather tall in the upright position) would detract from the appearance of the chair. Because the American Furniture Manufacturers' Association, in conjunction with furniture hardware manufacturers, have agreed for safety reasons that, in a reclined position, there be no space between ottomans greater than 5×5 inches, and because the front ottoman should provide a support surface at least 18 inches in front of the seat 167 for comfort, the front ottoman 163 is preferably greater in length (about 6 to 12 inches in overall length) than the intermediate ottoman 153 (which is typically between about 2 and 6 inches in overall length).

The chair 10 can be moved to the fully reclined position (shown in FIG. 4) by the occupant again pushing forward on the armrests 28*a*, 28*b* and rearward on the backrest 166 when the chair 10 is in the TV position. The rearward force on the backrest 166 causes the backpost 78 to rotate about the pivot 84 such that the upper end of the backpost 78 moves rearwardly and downwardly (this rotation is clockwise from the vantage point of FIG. 4). The pivoting of the backpost 78 drives the recline actuating link 74 forward, which in turn causes the full recline swing link 66 to rotate clockwise. As the front portion of the full recline swing link 66 rises, it draws the rear end of the transition link 86 upwardly. This action raises the carrier link 90, and consequently the seat mounting bracket 82 and the seat 167, upwardly and slightly rearwardly. The movement to the full recline position ceases when the backpost 78 strikes a pin (not shown) on the seat mounting bracket 82, at which point the seat 167 has risen about 2 inches and moved about 1 inch rearwardly.

During the movement of the chair 10 to the fully reclined position, the relationship between the front and rear ottoman swing links 110, 114 remains essentially unchanged. As a result, the front and intermediate ottomans 163, 153 rise and move slightly rearwardly in synchronous motion with the seat 167 but otherwise remain extended as in the TV position of FIG. 3.

The chair 10 can be returned from the fully extended position to the TV position by the occupant pushing forwardly on the armrests 28*a*, 28*b*, which reverses the motion of the aforementioned links and enables the chair 10 to take the TV position. The chair can be returned to the upright position from the TV position by the occupant pushing downwardly on the front ottoman 163, at which time the links described above as driving the chair to the TV position reverse their motion until the chair has returned to the upright position.

Those skilled in this art will recognize that other reclining mechanism configurations and portions thereof may be employed with the present invention. For example, portions of a three-way mechanism illustrated in U.S. Pat. No. 4,418,957 to Rogers that move the backrest and seat relative to the base may be employed. Similarly, portions of the pressback mechanisms illustrated in U.S. Pat. No. 5,775,775 to Hoffman that extend the ottoman may be employed. Other mechanisms may also be suitable for use with the present invention.

The foregoing demonstrates that the present invention can provide a chair that has aesthetic appeal and contemporary style, yet also has the function of a three-way recliner chair. The wrap-around upholstery can be attached without the need for components that compensate for stretching or bunching of the upholstery. The reclining mechanisms can be substantially obscured by the side rails of the seat frame, thereby preserving the attractive appearance of the chair. The front and intermediate ottomans can provide comfortable support for the occupant's legs and feet without the need for a separate footstool-type ottoman. Finally, the chassis assembly can by configured to provide attachment points for the reclining mechanisms without sacrificing chair style.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A recliner chair, comprising:

a base configured to rest on an underlying floor;

a swivel unit attached to said base;

a chassis assembly having a first longitudinal dimension mounted to said swivel unit;

an arm member mounted above said base and to said chassis assembly, said arm member having a horizontal run and two upright runs, said horizontal run being positioned above and in non-contacting relationship with the underlying floor, each of said upright runs having a second longitudinal dimension greater than or substantially equal to said first longitudinal dimension, said upright runs being positioned relative to said chassis assembly such that said chassis assembly is substantially hidden thereby in side view;

a seat having a seat frame, a lowermost portion of said seat frame being located at least 6 inches from the underlying surface;

a backrest;

an intermediate ottoman;

a front ottoman; and a pair of reclining mechanisms mounted to said chassis assembly, said seat and said backrest, said reclining mechanisms configured to move the seat and backrest relative to the base between:

an upright position, in which the backrest is generally upright, the seat is positioned above the base in a first position and forms a first angle with the backrest, the intermediate ottoman is disposed generally vertically and serves as a front portion of the chair, and the front ottoman is disposed generally horizontally below the seat and rearward of the intermediate ottoman;

a TV position, in which the front ottoman is generally horizontally disposed and inverted from said generally horizontal disposition in the upright position forward of the seat, the intermediate ottoman is generally horizontally disposed between the front ottoman and the seat, and the seat has moved to a second position rearwardly from the first position, and the backrest and seat form a second angle that is substantially equal to the first angle; and a fully reclined position, in which the front and intermediate ottomans remain generally horizontally disposed forward of the seat, the seat moves to a third position that is upward from the second position, and the backrest has pivoted relative to the seat such that a third angle formed by the backrest and the seat is greater than the second angle.

2. The chair defined in claim 1, wherein said chassis assembly comprises:

a pair of longitudinally-extending lower tube segments;

a pair of transversely-extending upper tube segments mounted upon said lower tube segments;

a lower plate mounted to and below said upper tube segments; and an upper plate mounted to and above said upper tube segments, said upper and lower plates being mounted to said swivel unit.

3. The chair defined in claim 1, wherein said intermediate ottoman has a length of between about 2 and 6 inches, and said front ottoman has a length of between about 6 and 10 inches.

4. The chair defined in claim 1, further comprising an upholstery layer fixed to said seat and to said intermediate ottoman, wherein said reclining mechanisms are configured such that a first wrap-around distance from a point on a rear edge of said seat to a point on a lower edge of said intermediate ottoman when said chair is in the upright position is substantially equal to a second wrap-around distance from said point on said rear edge of said seat to said point on said lower edge of said intermediate ottoman when the chair is in the TV position.

5. The chair defined in claim 1, wherein said horizontal run of said arm member includes a lowered central portion and raised lateral portions, and wherein said chassis assembly is mounted to said horizontal run raised lateral portions.

6. The chair defined in claim 1, wherein said seat frame includes a pair of transversely opposed side rails, each of said side rails having a height of between about 4 and 8 inches.

7. The chair defined in claim 1, wherein said reclining mechanism includes a seat mounting bracket attached to said seat frame, front and rear ottoman swing links pivotally attached to said seat mounting bracket, upper and lower ottoman extension links pivotally attached to, respectively, said rear and front ottoman swing links, an intermediate ottoman drive link pivotally attached to said upper ottoman extension link, and an intermediate ottoman bracket pivotally attached to said lower ottoman extension link and to said intermediate ottoman drive link and mounted to said intermediate ottoman, said front ottoman swing link and said upper ottoman extension link being pivotally attached to each other.

8. The chair defined in claim 7, wherein said reclining mechanism further comprises a front ottoman carrier link pivotally attached with said upper and lower ottoman extension links, a front ottoman bracket pivotally attached to said front ottoman carrier link and fixed to said front ottoman, and a front ottoman drive link pivotally attached to said lower ottoman extension link and to said front ottoman bracket.

9. The chair defined in claim 1, wherein in the upright position, a crown portion of said seat is positioned between about 15 and 22 inches above the underlying surface.

10. The chair defined in claim 1, wherein said base comprises a circular ring, a central hub, and a plurality of spokes extending radially outwardly from said hub to said ring.

11. The chair defined in claim 1, wherein said second longitudinal dimension of said arm member upright runs is between about 3 and 8 inches.

12. A recliner chair, comprising:

a base configured to rest on an underlying floor;

a swivel unit attached to said base;

a chassis assembly having a first longitudinal dimension mounted to said base;

an arm member mounted above said base and to said chassis assembly, said arm member having a horizontal run and two upright runs, said horizontal run being positioned above and in non-contacting relationship with the underlying floor, each of said upright runs having a second longitudinal dimension greater than or substantially equal to said first longitudinal dimension and between about 3 and 8 inches, said upright runs being positioned relative to said chassis assembly such that said chassis assembly is substantially hidden thereby in side view;

a seat having a seat frame, a lowermost portion of said seat frame being located at least 6 inches from the underlying surface, wherein said seta frame includes a pair of transversely opposed side rails having a height of between about 4 and 8 inches;

a backrest;

an intermediate ottoman;

a front ottoman; and a pair of reclining mechanisms mounted to said chassis assembly, said seat and said backrest, said reclining mechanisms configured to move the seat and backrest relative to the base between:

an upright position, in which the backrest is generally upright, the seat is positioned above the base in a first position and forms a first angle with the backrest, the intermediate ottoman is disposed generally vertically and serves as a front portion of the chair, and the front ottoman is disposed generally horizontally below the seat and rearward of the intermediate ottoman;

a TV position, in which the front ottoman is generally horizontally disposed and inverted from said generally horizontal disposition in the upright position forward of the seat, the intermediate ottoman is generally horizontally disposed between the front ottoman and the seat, and the seat has moved to a second position rearwardly from the first position, and the backrest and seat form a second angle that is substantially equal to the first angle; and a fully reclined position, in which the front and intermediate ottomans remain generally horizontally disposed forward of the seat, the seat moves to a third position that is upward from the second position, and the backrest has pivoted relative to the seat such that a third angle formed by the backrest and the seat is greater than the second angle.

13. The chair defined in claim 12, wherein said chassis assembly comprises:

a pair of longitudinally-extending lower tube segments;

a pair of transversely-extending upper tube segments mounted upon said lower tube segments;

a lower plate mounted to and below said upper tube segments; and an upper plate mounted to and above said upper tube segments, said upper and lower plates being mounted to said swivel unit.

14. The chair defined in claim 12, wherein said intermediate ottoman has a length of between about 2 and 6 inches, and said front ottoman has a length of between about 6 and 12 inches.

15. The chair defined in claim 12, further comprising an upholstery layer fixed to said seat and to said intermediate ottoman, wherein said reclining mechanisms are configured such that a first wrap-around distance from a point on a rear edge of said seat to a point on a lower edge of said intermediate ottoman when said chair is in the upright position is substantially equal to a second wrap-around distance from said point on said rear edge of said seat to said point on said lower edge of said intermediate ottoman when the chair is in the TV position.

16. The chair defined in claim 1, wherein said horizontal run of said arm member includes a lowered central portion and raised lateral portions, and wherein said chassis assembly is mounted to said horizontal run raised lateral portions.

17. A recliner chair, comprising:

a base configured to rest on an underlying floor;

a swivel unit attached to said base;

a chassis assembly having a first longitudinal dimension mounted to said base;

an arm member mounted above said base and to said chassis assembly, said arm member having a horizontal run and two upright runs, said horizontal run being positioned above and in non-contacting relationship with the underlying floor, each of said upright runs having a second longitudinal dimension greater than or substantially equal to said first longitudinal dimension, said upright runs being positioned relative to said chassis assembly such that said chassis assembly is substantially hidden thereby in side view;

a seat having a seat frame, a lowermost portion of said seat frame being located at least 6 inches from the underlying surface;

a backrest;

an intermediate ottoman;

a front ottoman; and a pair of reclining mechanisms mounted to said chassis assembly, said seat and said backrest, said reclining mechanisms configured to move the seat and backrest relative to the base between:

an upright position, in which the backrest is generally upright, the seat is positioned above the base in a first position and forms a first angle with the backrest, the intermediate ottoman is disposed generally vertically and serves as a front portion of the chair, and the front ottoman is disposed generally horizontally below the seat and rearward of the intermediate ottoman;

a TV position, in which the front ottoman is generally horizontally disposed and inverted from said generally horizontal disposition in the upright position forward of the seat, the intermediate ottoman is generally horizontally disposed between the front ottoman and the seat, and the seat has moved to a second position rearwardly from the first position, and the backrest and seat form a second angle that is substantially equal to the first angle; and a fully reclined position, in which the front and intermediate ottomans remain generally horizontally disposed forward of the seat, the seat moves to a third position that is upward from the second position, and the backrest has pivoted relative to the seat such that a third angle formed by the backrest and the seat is greater than the second angle;

wherein said reclining mechanism includes a seat mounting bracket attached to said seat frame, front and rear ottoman swing links pivotally attached to said seat mounting bracket, upper and lower ottoman extension links pivotally attached to, respectively, said rear and front ottoman swing links, an intermediate ottoman drive link pivotally attached to said upper ottoman extension link, and an intermediate ottoman bracket pivotally attached to said lower ottoman extension link and to said intermediate ottoman drive link and mounted to said intermediate ottoman, said front ottoman swing link and said upper ottoman extension link being pivotally attached to each other; and wherein said reclining mechanism further comprises a front ottoman carrier link pivotally attached with said upper and lower ottoman extension links, a front ottoman bracket pivotally attached to said front ottoman carrier link and fixed to said front ottoman, and a front ottoman drive link pivotally attached to said lower ottoman extension link and to said front ottoman bracket.

18. The chair defined in claim 17, wherein said intermediate ottoman has a first length, said front ottoman has a second length, and said second length is greater than said first length.

19. The chair defined in claim 18, wherein said first length is between about 2 and 6 inches, and said second length is between about 6 and 12 inches.

* * * * *